US005447240A

United States Patent [19]

Makino

[11] Patent Number: 5,447,240

[45] Date of Patent: Sep. 5, 1995

[54] APPARATUS FOR DETERMINING WHETHER A SHEET IS OF A FIRST TYPE OR A SECOND TYPE

[75] Inventor: Tomonori Makino, Tokyo, Japan

[73] Assignee: Kabushiki Kaisha Toshiba, Kawasaki, Japan

[21] Appl. No.: 216,836

[22] Filed: Mar. 24, 1994

[30] Foreign Application Priority Data

Mar. 25, 1993 [JP] Japan ..... 5-067124

[51] Int. Cl.[6] ..... B07C 5/12; B65H 7/12

[52] U.S. Cl. ..... 209/576; 209/603; 209/900; 271/263; 382/135

[58] Field of Search ..... 209/534, 576, 577, 583, 209/587, 600, 601, 603, 604, 900; 271/262, 263; 382/7; 53/54

[56] References Cited

U.S. PATENT DOCUMENTS 3,930,582 1/1976 Gartner et al. ..... 209/534
4,374,463 2/1983 Omura et al. ..... 53/54
5,131,648 7/1992 Ito ..... 271/262

FOREIGN PATENT DOCUMENTS 127540 5/1989 Japan ..... 271/263
2211976 7/1989 United Kingdom ..... 209/534

*Primary Examiner*—William E. Terrell
*Assistant Examiner*—Tuan N. Nguyen
*Attorney, Agent, or Firm*—Cushman Darby & Cushman

[57] ABSTRACT

An apparatus for determining whether a sheet is of a first type or a second type, the sheet including two marks printed on opposite halves of the sheet. The apparatus includes a thickness detector for detecting a thickness of the sheet to detect parts greater than a predetermined thickness, an image input unit for imaging the two marks of the sheet, a judging unit for determining a check condition when any part thicker than the predetermined thickness is located between the two marks and extend between lengthwise edges of the sheet, a comparison unit for comparing the images of the two marks of the sheet imaged by the image input unit when the judging unit determines the check condition and for providing a result signal representative of whether the two marks correspond to each other, and a determining unit for determining in response to the result signal that the sheet is of the first type when the two marks correspond to each other and of the second type when the two marks do not correspond to each other.

16 Claims, 7 Drawing Sheets

14

| | $a_1$ | $a_2$ | $a_3$ | $a_4$ | $a_5$ | $a_6$ | $a_7$ | $a_8$ |
|---|---|---|---|---|---|---|---|---|
| $b_1$ | 0 | 0 | 0 | 0 | 0 | 0 | 0 | 0 |
| $b_2$ | 0 | 1 | 1 | 1 | 1 | 1 | 1 | 0 |
| $b_3$ | 0 | 1 | 1 | 1 | 1 | 1 | 1 | 0 |
| $b_4$ | 0 | 0 | 1 | 1 | 1 | 1 | 1 | 0 |
| $b_5$ | 0 | 0 | 1 | 1 | 1 | 1 | 1 | 0 |
| $b_6$ | 0 | 1 | 1 | 1 | 1 | 1 | 1 | 0 |
| $b_7$ | 0 | 1 | 1 | 1 | 1 | 1 | 1 | 0 |
| $b_8$ | 0 | 1 | 1 | 1 | 2 | 2 | 2 | 0 |
| $b_9$ | 0 | 1 | 2 | 2 | 2 | 2 | 2 | 0 |
| $b_{10}$ | 0 | 2 | 2 | 2 | 2 | 1 | 1 | 0 |
| $b_{11}$ | 0 | 2 | 2 | 1 | 1 | 1 | 1 | 0 |
| $b_{12}$ | 0 | 1 | 1 | 1 | 1 | 1 | 1 | 0 |
| $b_{13}$ | 0 | 1 | 1 | 1 | 1 | 1 | 1 | 0 |
| $b_{14}$ | 0 | 1 | 1 | 1 | 1 | 1 | 1 | 0 |
| $b_{15}$ | 0 | 1 | 1 | 1 | 1 | 1 | 1 | 0 |
| $b_{16}$ | 0 | 0 | 0 | 0 | 0 | 0 | 0 | 0 |

APPARATUS FOR DETERMINING WHETHER A SHEET IS OF A FIRST TYPE OR A SECOND TYPE

BACKGROUND OF THE INVENTION

2. Field of the Invention

The present invention relates to an apparatus for determining conditions of various kinds of sheets such as securities.

2. Description of the Related Art

As shown in the U.S. Pat. No. 4,374,463 (Feb. 22, 1983), a conventional apparatus automatically classifies various kinds of sheets to be discriminated, such as securities, into three groups: a first group of sheets which have not been substantially stained, a second group of sheets which have been substantially stained and a third group of sheets which have been forged for unjust purposes. One example of the third group of sheets may be a sheet S which has been reproduced as if one sheet by joining intentionally cut pieces of two different sheets S1 and S2 with an adhesive tape T applied, as shown in FIG. 2.

On the conventional apparatus for discriminating sheets, a thickness of a sheet to be discriminated is measured over its whole surface and a portion of the sheet thicker than the original thickness is detected through this measurement as a portion on which an adhesive tape is applied. A sheet with adhesive tape applied from one end to the other of the sheet was discriminated to be the third group of sheets.

In the conventional apparatus for discriminating sheets such as described above, those sheets with adhesive tape applied from one end to the other Of the sheet are all classified to be in the third group of sheets. Therefore, there was a problem that sheets which should have been classified in the second group of sheets were instead classified in the third group of sheets. As a result, a sheet that was originally one sheet but was cut completely into two separate pieces and then restored to one sheet by mending using an adhesive tape and which should have been classified in the second group of sheets, was classified in the third group.

SUMMARY OF THE INVENTION

It is an object of the present invention to provide an apparatus for discriminating sheets, which is capable of properly discriminate between sheets forged using an unjust means and sheets mended using adhesive tape.

The present invention provides an apparatus for determining whether a sheet is of a first type or a second type, the sheet including two marks printed on opposite halves of the sheet, comprising means for detecting a thickness of the sheet to detect parts greater than a predetermined thickness; means for imaging the two marks of the sheet; judging means for determining a check condition when any part thicker than the predetermined thickness is located between the two marks and extend between lengthwise edges of the sheet; means for comparing the images of the two marks of the sheet imaged by the imaging means when the judging means determines the check condition, and for providing a result signal representative of whether the two marks correspond to each other; and means, responsive to the result signal, for determining that the sheet is of the first type when the two marks correspond to each other and of the second type when the two marks do not correspond to each other.

Further, the present invention provides a method for determining whether a sheet is of a first type or a second type, the sheet including two marks printed on opposite halves of the sheet, the method comprising the steps of detecting a thickness of the sheet to detect parts greater than a predetermined thickness; imaging the two marks of the sheet; determining a check condition when any part thicker than the predetermined thickness is located between the two marks and extend between lengthwise edges of the sheet; comparing the images of the two marks of the sheet imaged by the step of imaging when the step of determining a check condition determines the check condition, and providing a result signal representative of whether the two marks correspond to each other; and determining in response to the result signal that the sheet is of the first type when the two marks correspond to each other and of the second type when the two marks do not correspond to each other.

DETAILED DESCRIPTION OF THE PREFERRED EMBODIMENTS

Hereinafter, a preferred embodiment of the present invention will be described with reference to the drawings.

Figure 1:
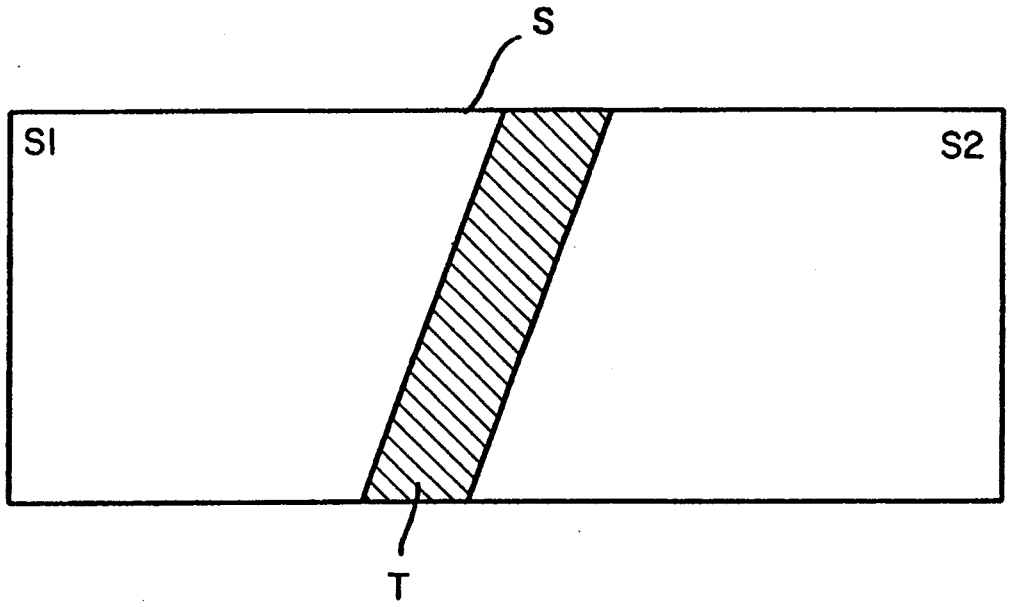
FIG. 1 is a plan view showing an example of a sheet forged using an unjust means.
Figure 2:
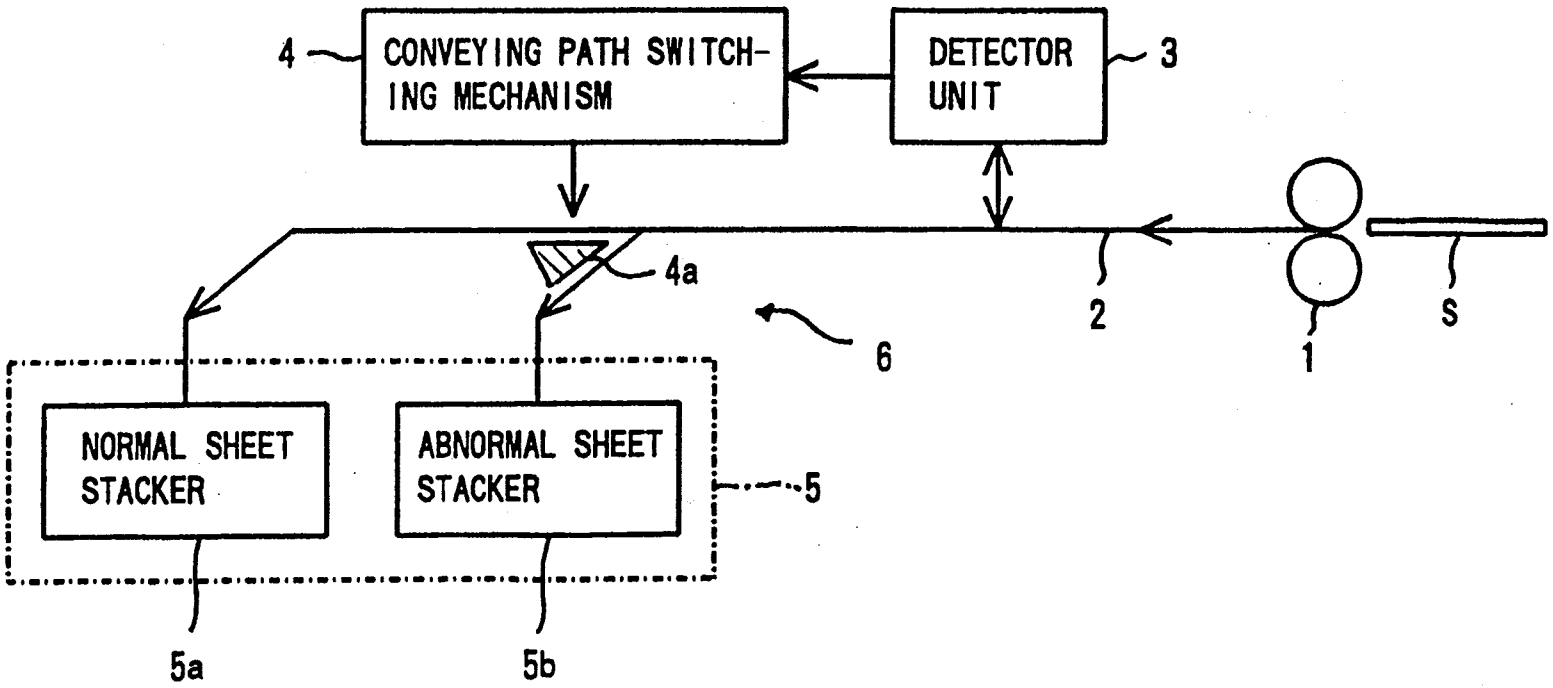
FIG. 2 is a block diagram showing the entire construction of one embodiment of an apparatus for discriminating between sheets, in accordance with the present invention.

FIG. 2 is a block diagram for explaining the entire construction of the sheet discriminating apparatus in accordance with the present invention. In FIG. 2, a reference numeral 1 denotes a sheet take-in port for taking a sheet S into the apparatus for discriminating sheets. A reference numeral 2 denotes a sheet conveying path in the apparatus. The sheet S taken in through the sheet take-in port 1 is conveyed through the conveying path 2. The sheet S conveyed through the conveying path 2 is conveyed to a detector unit 3. The detailed construction of the detector unit 3 will be described later. After a detection process by the detector unit 3, the sheet S is conveyed to a sheet sorter 6. The sheet sorter 6 comprises a conveying path switching mechanism 4 and a sheet stacker 5. The sheet stacker 5 comprises a first sheet stacker 5*a* and a second sheet stacker 5*b*. The conveying path switching mechanism 4 switches a destination of the sheet S to be conveyed either to the first sheet stacker 5*a* or the second sheet stacker 5*b* according to data which is output from the detector unit 3 showing the result of judgment for the sheet S. That is, the conveying path switching mechanism 4 switches a gate 4a provided in the conveying path 2. By this operation, the first group of sheets which have not been substantially stained and the second group of sheets which haven been substantially stained are stacked in the first sheet stacker 5*a*. The third group of sheets forged using unjust means are stacked in the second sheet stacker 5*b*.

Figure 3:
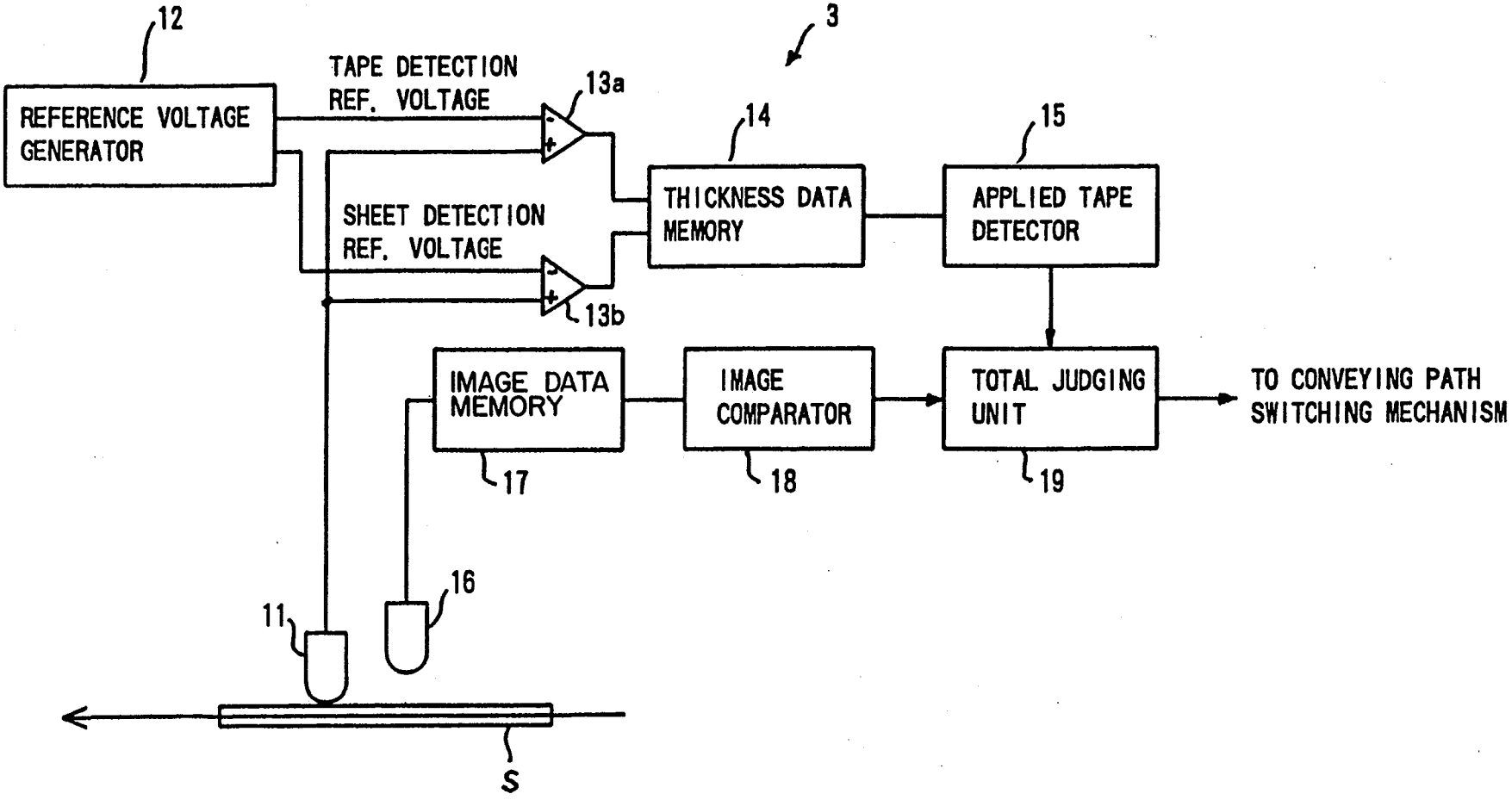
FIG. 3 is a block diagram showing the construction of a detector unit of the apparatus shown in FIG. 2.
Figure 4B:
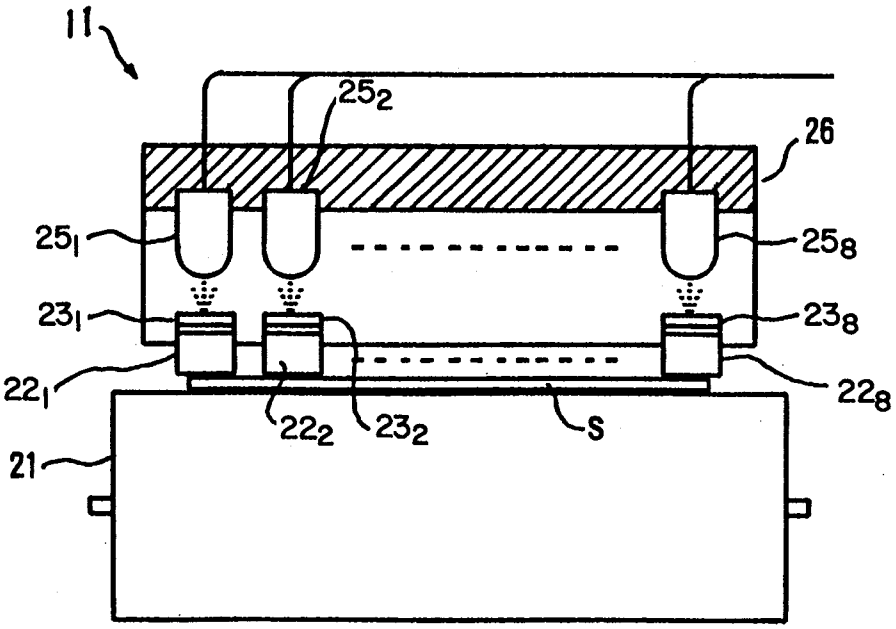
FIG. 4B is a front view showing the construction of the thickness detector in the detector unit shown in FIG. 3.
Figure 4A:
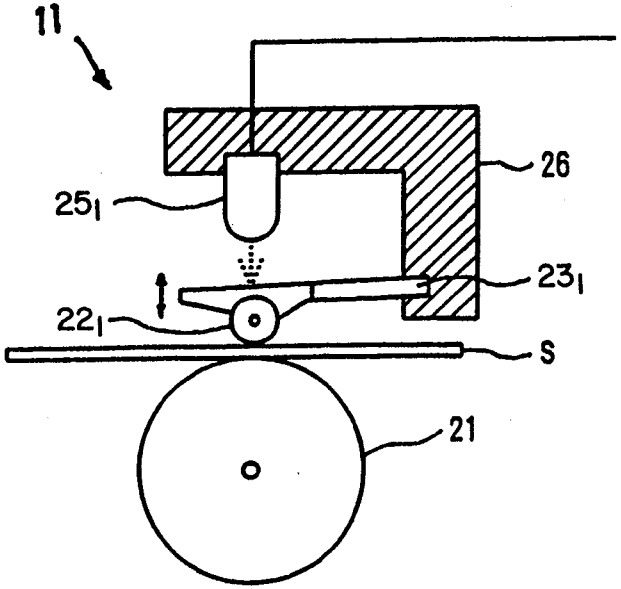
FIG. 4A is a side view showing the construction of a thickness detector in the detector unit shown in FIG. 3.

Next, the construction of the detector unit 3 will be described with reference to FIG. 3. In FIG. 3, a reference numeral 11 denotes a thickness detector for detecting a thickness of the sheet S. A construction of the thickness detector 11 is shown in FIGS. 4A and 4B.

That is, there are moving rollers $22_1$–$22_8$ arranged at locations opposite to a fixed roller 21 provided along the conveying path 2. As shown in FIG. 4B, there are eight moving rollers $22_1$–$22_8$ arranged in a row parallel to the axial direction of the fixed roller 21. These moving rollers $22_1$–$22_8$ are mounted on the free ends of leaf springs $23_1$–$23_8$, respectively and other ends of these leaf springs $23_1$–$23_8$ are mounted to a block 26. As the moving rollers $22_1$–$22_8$ are mounted to the free ends of the leaf springs $23_1$–$23_8$, the moving rollers $22_1$–$22_8$ are movable in the direction of arrow A, respectively as shown in FIG. 4A.

In the upper part of the moving rollers $22_1$–$22_8$, there are position sensors $25_1$–$25_8$ arranged at the locations opposite to the moving rollers $22_1$–$22_8$ at a prescribed distance, respectively. These position sensors $25_1$–$25_8$ are mounted to the block 26. These position sensors $25_1$–$25_8$ output electrical signals corresponding to the movement amount of the moving rollers $22_1$–$22_8$ in the direction of arrow A, perpendiculay to the sheet S.

Figure 5:
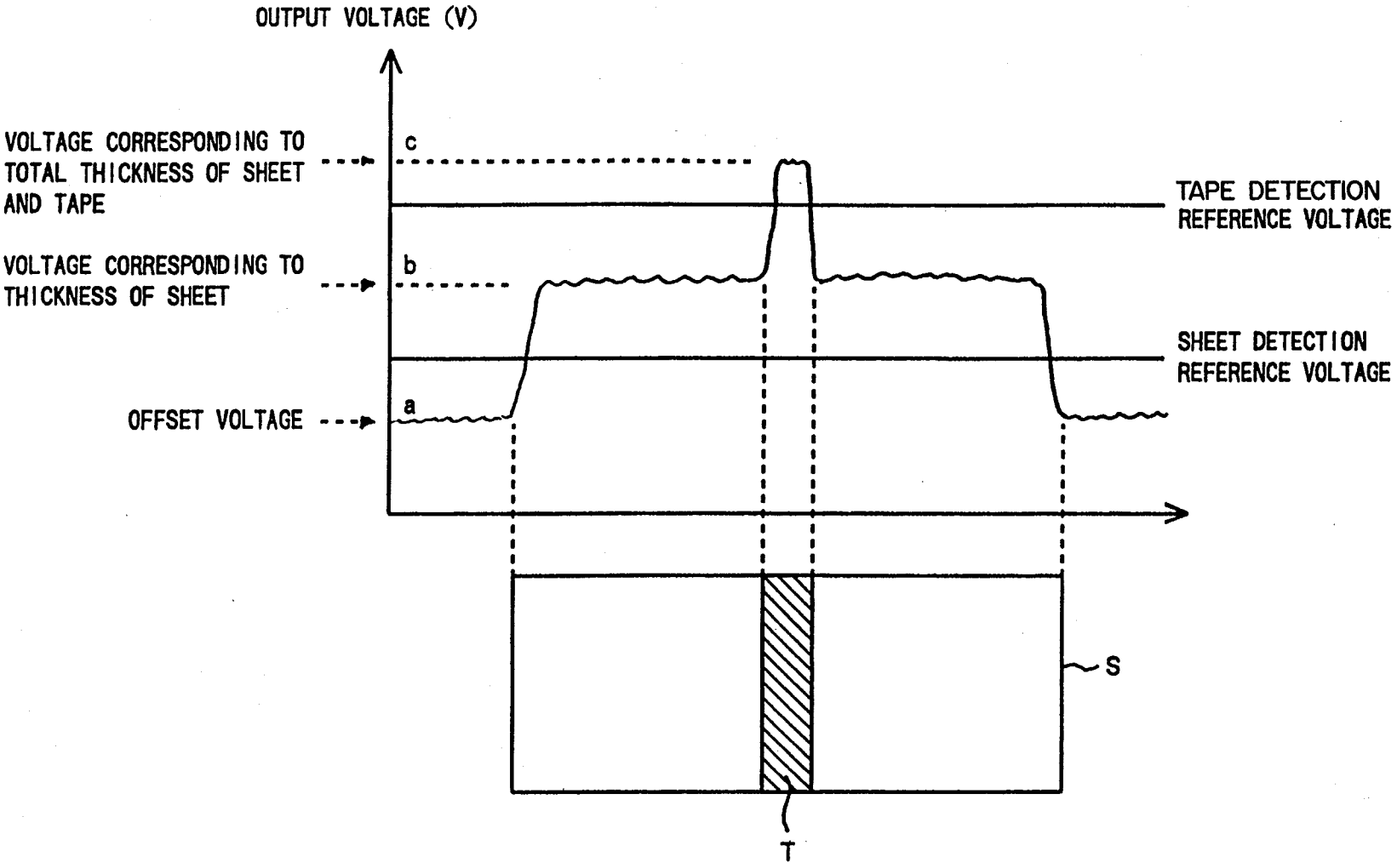
FIG. 5 is a waveform diagram showing the output waveforms of position sensors in the thickness detector shown in FIGS. 4A and 4B.

When the sheet S being conveyed passes between the fixed roller 21 and the moving rollers $22_1$–$22_8$, the leaf springs $23_1$–$23_8$ are bent corresponding to a thickness of the sheet S and the moving rollers $22_1$–$22_s$ move perpendiculay to the sheet S. Here, the movement of the moving rollers $22_1$–$22_8$ is measured as an electric signal using the position sensors $25_1$–$25_8$. As an example, the output waveform of the position sensors $25_1$–$25_8$ when the sheet S with an adhesive tape T applied over the full width at its central part passed through the thickness detector unit 3 is shown in FIG. 5. That is, shown in FIG. 5 is a detected waveform comprising an offset voltage a (V) showing that the sheet S does not exist, a voltage b (V) corresponding to a thickness of a normal sheet in excess of a sheet detection reference voltage, and a voltage c (V) corresponding to a total thickness of a sheet and an adhesive tape in excess of an applied tape detection reference voltage.

Returning to FIG. 3, a reference voltage generator 12 generates voltages which are references for discriminating the state of a Thickness of the sheet S and outputs both a sheet detection reference voltage d and a tape detection reference voltage e shown in FIG. 5. The reference voltage generator 12 is connected to a first comparator 13*a* and a second comparator 13*b* so that the tape detection reference voltage that is output from the reference voltage generator 12 is input to the negative terminal of the first comparator 13*a* and the sheet detection reference voltage is input to the negative terminal of the second comparator 13*b*. The thickness detector 11 is connected to both the positive terminals of the first comparator 13*a* and the second comparator 13*b* so that the detected thickness voltages are input thereto.

The output terminals of the first comparator 13*a* and the second comparator 13*b* are connected to a thickness data memory 14. That is, voltages corresponding to thickness detected by the thickness detector 11 are compared with reference voltages generated from the reference voltage generator 12 by the first and the second comparators 13*a* and 13*b*, respectively. Thickness data at each section of the sheet S thus obtained through this comparison is stored in the thickness data memory 14.

Figure 6:
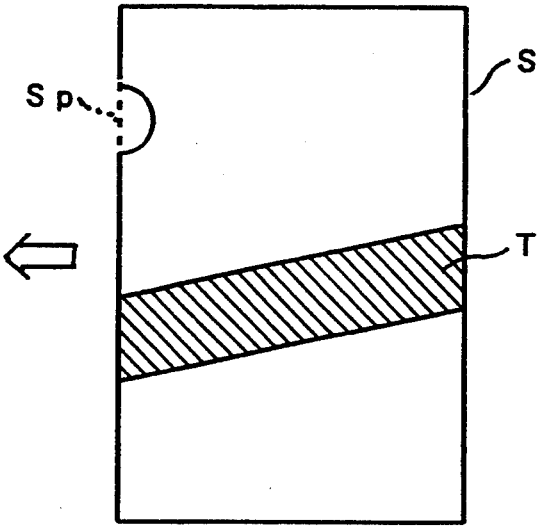
FIG. 6 is a memory map showing the contents of a thickness data memory shown in FIG. 3.

The contents of the thickness data memory 14 in the state of storing thickness data are shown in FIG. 6. That is, the thickness data memory 14 stores data "0" representing the state of no sheet S existing, data "1" representing the state of the sheet S existing and data representing the state of the sheet having adhesive tape applied thereto. Data "0" is also stored in the thickness data memory 14 corresponding to missing portions of sheet S, such as portion Sp. Further, $a_1$–$a_8$ show the locations of the moving rollers $22_1$–$22_s$, while $b_1$–$b_8$ show conveying distances of the sheet S.

Returning to FIG. 3, the output terminal of the thickness data memory 14 is connected to an applied tape detector 15. In the applied tape detector 15, thickness data being stored in the thickness data memory 14 is read using a data processor and based on this reading of thickness data, the shape of the tape T applied to the sheet S is recognized. Based on this result of recognition, it is distinguished whether the adhesive tape T is applied to the sheet S to extend between lengthwise edges of the sheet to divide between a first number and a second number (described later), which are printed on opposite halves of the sheet S, into two parts. The distinguished result is input to a total judging unit 19 to which the applied tape detector 15 is connected.

Figure 7:
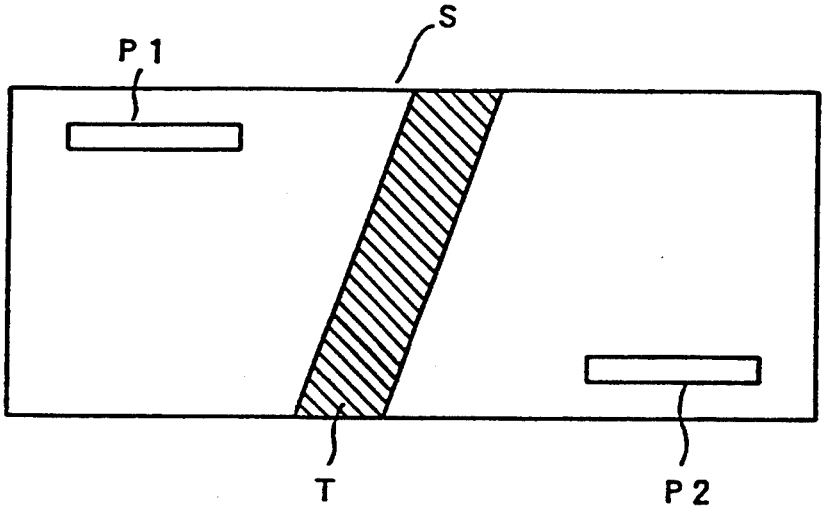
FIG. 7 is a plan view of a sheet showing the state with numbers printed at two points.

A reference numeral 16 denotes an image input unit such as, for instance, a CCD (Charge Coupled Device) camera, image a part of or the whole surface of the sheet S. This image input unit 16 is connected to an image data memory The image data of the sheet S imaged by the image input unit 16 is stored in the image data memory 17. Further, the image data memory 17 is connected to an image comparator 18 and image data of the sheet S stored in the image data memory 17 is read using a processor in the image comparator 28. From the read image data, numbers P1 and P2 previously printed on the upper left and the lower right of the sheet S are extracted by the processor as shown in FIG. 7. Further, images may be extracted from stationary locations on the basis of the edge of the sheet S or on the basis of any other pattern printed on the sheet S.

In the image comparator 18, the extracted images of the numbers P1 and P2 are compared to see if correspond to each other, i.e., they are the same, and the result is input to the total judging unit 19 connected to the image comparator 18.

The distinguished result relative to adhesive tape applied to the sheet S is input to the total judging unit 19 from the applied tape detector 15 and the comparison result of two numbers on the sheet S from the image comparator 18 is also input to the total judging unit 19. In the total judging unit 19, it is judged whether the sheet S is a sheet forged by unjustly joining using an adhesive tape based on the distinguished result relative to the tape applied to the sheet S and the comparison result of two numbers on the sheet S. The result of this judgment is input to the conveying path switching mechanism 4.

Figure 8:
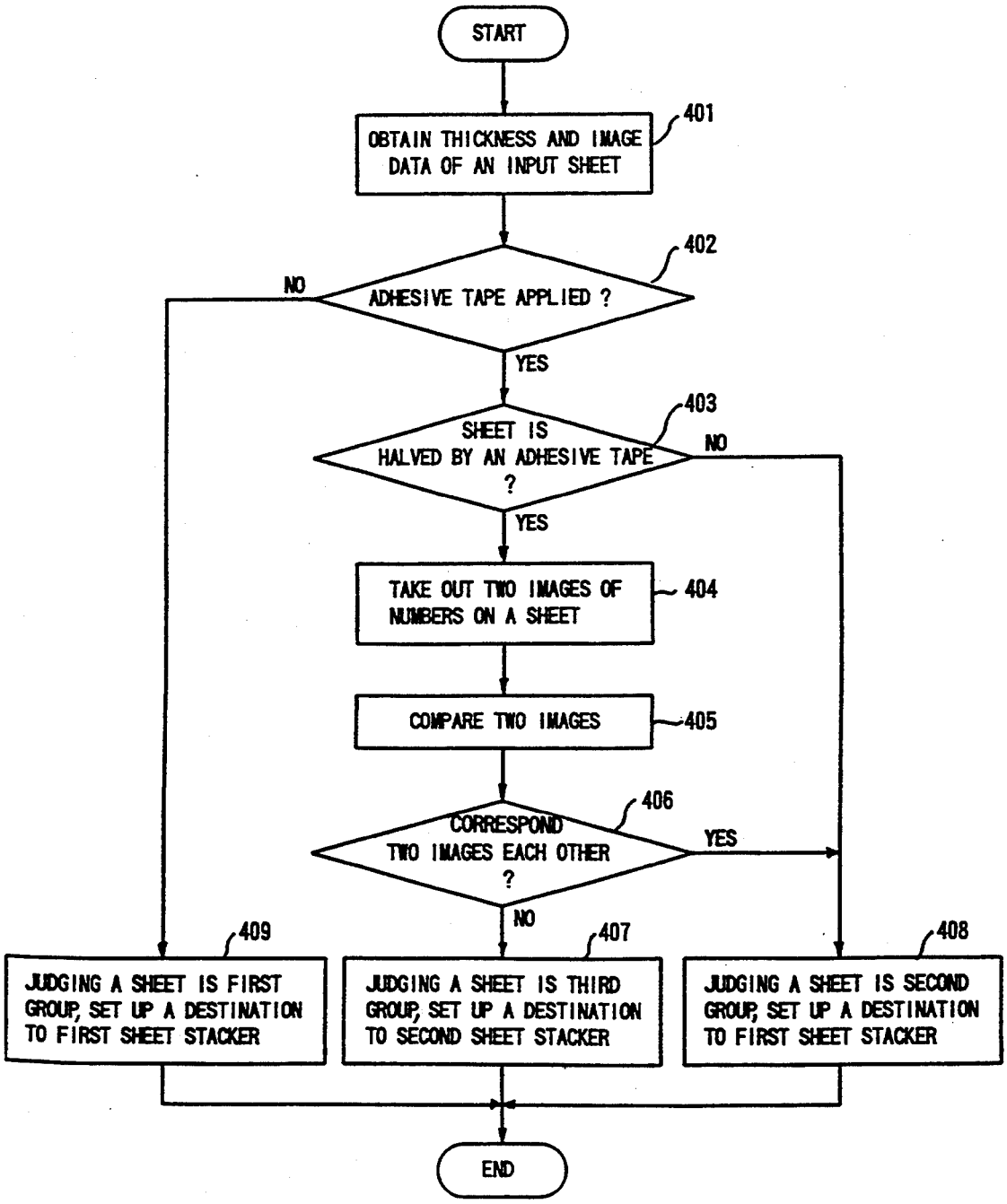
FIG. 8 is a flowchart showing the operating steps of the apparatus for discriminating between sheets.

Next, the operation of the apparatus for discriminating sheets in this embodiment will be described with reference to the flowchart shown in FIG. 8.

The sheet S manually inserted into the apparatus for discriminating sheets through the sheet take-in port 1 is conveyed along the conveying path 2. During this conveyance, the discriminating operation of the sheet S by the detector unit 3 is carried out as described below.

First, voltages corresponding to a thickness of the sheet S is detected on its whole surface by the thickness detector 11. A voltage corresponding to the detected thickness of the sheet is input to the positive terminals of the first and the second comparators 13*a* and 13*b*, respectively. Then, this voltage is compared with the tape detection reference voltage and the sheet detection reference voltage input to the negative terminals of the first and the second comparators 13*a* and 13*b* from the reference voltage generator 12. Through this comparison, data relative to the existence of adhesive tape applied on the surface of the sheet S is obtained. This data relative to the existence of the applied tape is stored in the thickness data memory 14. Further, image data of the whole surface or any required part of the sheet S is imaged by the image input unit 16. This image data is stored in the image data memory 17 (Step 401).

Then, the applied tape detector 15 reads data relative to the existence of the applied tape being stored in the thickness data memory 14 and the existence of an applied tape is checked (Step 402). The checked result on the existence of the applied tape is input to the total judging unit 19. With respect to the check by the applied tape detector 15, if the existence of an adhesive tape is recognized, the shape of the tape is analyzed and it is checked whether the tape is applied over the surface of the sheet S to extend between lengthwise edges of the sheet to be between the printed numbers P1 and P2 on opposite halves of the sheet S (Step 403). This check is made in such a manner that if data "2" being stored in the thickness data memory 14 exists at the locations $a_2$ through $a_7$ corresponding to the portions where the moving rollers $22_2$ through $22_1$ are arranged, it is judged that the adhesive tape T is applied from one lengthwise edge to the other of the sheet S that is, the tape T is applied between the numbers P1 and P2, which are printed on the sheet S. The result of this check is also input to the total judging unit 19.

If the check in Step 403 reveals that an adhesive tape T is applied to the sheet S between the numbers P1 and P2 printed on the sheet S, the total judging unit 19 outputs an operating instruction to the image comparator 18. Following this operating instruction, the image comparator 18 extracts the images of the numbers P1 and P2 printed at two points on the sheet S from the image data of the sheet S being stored in the image data memory 17 (Step 404). The image comparator 18 compares the extracted images of the numbers P1 and P2 with each other (Step 405). The image comparator 18 judges whether the numbers P1 and P2 are correspond to each Other through the comparison in Step 405 (Step 406). The result of this judgment is input to the total judging unit 19.

Originally, the numbers P1 and P2 printed at two points on a sheet S are identical to each other on every sheet. Therefore, if it is judged that they are not the same as each other (Step 406: NO) in the result of comparison by the image comparator 18, the total judging unit 19 finally judges that the sheet S is classified for the third group of sheets. Then, the total judging unit 19 gives an instruction to the conveying path switching mechanism 4 to set up a conveying destination to the second sheet stacker 5*b* (Step 407).

Further, if the result of comparison by the image comparator 18 is judged that the numbers P1 and P2 are identical to each other (Step 408: YES), the total judging unit 19 finally judges that the sheet S is a sheet of the second group and gives an instruction to the conveying path switching mechanism 4 to set up the conveying destination to the first sheet stacker 5*a* (Step 408).

Further, if any portion of a sheet S thicker than its original thickness was not detected in the thickness detection in Step 402, the total judging unit 19 judges that this sheet S is a sheet of the first group and gives an instruction to the conveying path switching mechanism 4 to set up a conveying destination to the first sheet stacker 5*a* (Step 409).

As described above, according to the apparatus for discriminating sheets involved in this embodiment, even a sheet S with an adhesive tape T applied from its one end to the other of the sheet, the sheet is judged to be a sheet which was not forged using unjust means if two numbers P1 and P2 printed on the sheet S are the same. Accordingly, even a sheet of the second group which was originally one sheet but broken and mended using an adhesive tape, can be properly discriminated without being discriminated to be the third group of sheets.

Further, although images of the numbers are compared directly with each other in the embodiment described above, if character components of numbers only are extracted from number images and compared for their printed colors and depths, etc., more accurate judgement can be made. Further, it may also be possible to recognize characters from number images and compare recognized results for each character.

Although numbers printed at two points on a sheet S to be discriminated were compared in the embodiment described above, even in the case of a sheet with a plurality of letters of the alphabet, figures or patterns printed instead of numbers, it is also possible to discriminate the sheet.

As described above, the apparatus for discriminating sheets of the present invention discriminates a sheet by comparing characters printed at two points on the sheet. It is therefore possible to properly discriminate a sheet of the second group mended using an adhesive tape and a sheet of the third group and thus, discriminating accuracy can be improved.

While an example has been classified in which the tape extends to the edges, the present invention is not limited. The data presense of applied tape detecter 15 can be programmed to detect other tape orientations, e.g., tape which extends between the length wise edges of the sheet without reaching such edges.

What is claimed is:

1. An apparatus for determining whether a sheet is of a first type or a second type, the sheet including two marks printed on opposite halves of the sheet, comprising:

means for detecting a thickness of the sheet to detect parts greater than a predetermined thickness;

means for imaging the two marks of the sheet;

judging means for determining a check condition when any part thicker than the predetermined thickness is located between the two marks and extend between lengthwise edges of the sheet;

means for comparing the images of the two marks of the sheet imaged by the imaging means when the judging means determines the check condition, and for providing a result signal representative of whether the two marks correspond to each other; and means, responsive to the result signal, for determining that the sheet is of the first type when the two marks correspond to each other and of the second type when the two marks do not correspond to each other.

2. An apparatus as claimed in claim 1, wherein the thickness detecting means includes;

a conveying path on which the sheet is conveyed;

a plurality of rollers contacting the sheet and moving in a direction substantially perpendicular to the sheet in accordance with the thickness of the sheet; and a plurality of sensors which output a signal in accordance with the magnitude of perpendicular movement of the rollers.

3. An apparatus as claimed in claim 1, wherein the imaging means includes a charge coupled device (CCD).

4. An apparatus as claimed in claim 1, further comprising:

stacker means for separately stacking the first type and the second type of sheet.

5. An apparatus as claimed in claim 1, further comprising:

first stacker means for stacking sheets for which the first judging means does not determine a check condition and sheets of the first type; and second stacker means for stacking sheets of the second type.

6. An apparatus for determining whether a sheet is of a first type or a second type, the sheet including two marks printed on opposite halves of the sheet, comprising:

means for generating a sheet detection reference voltage for detecting a sheet and a tape detection reference voltage for detecting a tape on the sheet;

means for outputting a thickness voltage corresponding to the detected thickness of the sheet;

means for inputting an image of the sheet;

first comparing means for comparing the thickness voltage with the sheet detection reference voltage and the tape detection reference voltage and for providing a comparison signal;

means, responsive to the comparison signal, for generating data related to a thickness of the sheet;

means, responsive to the thickness data, for generating a check signal upon detecting the existence of tape located between the two marks and extending between lengthwise edges of the sheet;

means for extracting images of the two marks from the image of the sheet in response to the check signal;

second comparing means for comparing the images of the two marks and for providing a result signal representative of whether the images of the two marks correspond to each other; and means, responsive to the result signal, for determining that the sheet is of the first type when the two marks correspond to each other and of the second type when the two marks do not correspond to each other.

7. An apparatus as claimed in claim 6, wherein the thickness voltage outputting means includes;

a conveying path on which the sheet is conveyed;

a plurality of rollers contacting the sheet and moving in a direction substantially perpendicular to the sheet in accordance with the thickness of the sheet; and a plurality of sensors which output a signal in accordance with the magnitude of perpendicular movement of the rollers.

8. An apparatus as claimed in claim 6, wherein the inputting means includes a charge coupled device (CCD).

9. An apparatus as claimed in claim 6, further comprising:

stacker means for separately stacking the first type and the second type of sheet.

10. An apparatus as claimed in claim 6, further comprising:

first stacker means for stacking sheets for which the means for generating a check signal does not generate a check signal and sheets of the first type; and second stacker means for stacking sheets of the second type.

11. A method for determining whether a sheet is of a first type or a second type, the sheet including two marks printed on opposite halves of the sheet, the method comprising the steps of:

detecting a thickness of the sheet to detect parts greater than a predetermined thickness;

imaging the two marks of the sheet;

determining a check condition when any part thicker than the predetermined thickness is located between the two marks and extend between lengthwise edges of the sheet;

comparing the images of the two marks of the sheet imaged by the step of imaging when the step of determining a check condition determines the check condition, and providing a result signal representative of whether the two marks correspond to each other; and determining in response to the result signal that the sheet is of the first type when the two marks correspond to each other and of the second type when the two marks do not correspond to each other.

12. A method as claimed in claim 11, further comprising the step of:

separately stacking the first type and the second type of sheet.

13. A method as claimed in claim 11, further comprising the steps of:

stacking sheets for which the step of determining a chuck condition does not determine a chuck condition and sheets of the first type; and stacking sheets of the second type.

14. A method for determining whether a sheet is of a first type or a second type, the sheet including two marks-, printed on opposite halves of the sheet, the method comprising the steps of:

generating a sheet detection reference voltage for detecting a sheet and a tape detection reference voltage for detecting a tape on the sheet;

outputting a thickness voltage corresponding to the detected thickness of the sheet;

inputting an image of the sheet;

comparing the thickness voltage with the sheet detection reference voltage and the tape detection reference voltage and providing a comparison signal;

generating data related to a thickness of the sheet in response to the comparison signal;

generating in response to the thickness data a check signal upon detecting the existence of tape located between the two marks and extending between lengthwise edges of the sheet;

extracting images of the two marks from the image of the sheet in response to the check signal;

comparing the images of the two marks and providing a result signal representative of whether the images of the two marks correspond to each other; and determining in response to the result signal that the sheet is of the first type when the two marks correspond to each other and of the second type when the two marks do not correspond to each other.

15. A method as claimed in claim 14, further comprising the step of:

separately stacking the first type and the second type of sheet.

16. A method as claimed in claim 14, further comprising the steps of:

stacking sheets for which the step of generating a check signal does not generate a check signal and sheets of the first type; and stacking sheets of the second type.

* * * * *